US008464524B2

(12) United States Patent
Bidner et al.

(10) Patent No.: US 8,464,524 B2
(45) Date of Patent: Jun. 18, 2013

(54) TRAP FOR EXHAUST SYSTEM

(75) Inventors: David Karl Bidner, Livonia, MI (US); John M. Roth, Grosse Ile, MI (US); Ken O. Jahr, West Bloomfield, MI (US); Gopichandra Surnilla, West Bloomfield, MI (US); James Michael Kerns, Trenton, MI (US); Timothy Joseph Clark, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1135 days.

(21) Appl. No.: 12/187,217

(22) Filed: Aug. 6, 2008

(65) Prior Publication Data

US 2010/0031645 A1 Feb. 11, 2010

(51) Int. Cl.
*F01N 3/02* (2006.01)

(52) U.S. Cl.
USPC ..... 60/309; 60/274; 60/301; 60/324

(58) Field of Classification Search
USPC ..... 60/274, 298, 301, 309, 320, 324
See application file for complete search history.

(56) References Cited

U.S. PATENT DOCUMENTS

| | | | | |
|---|---|---|---|---|
| 4,725,359 | A * | 2/1988 | Ray | 210/640 |
| 5,389,747 | A | 2/1995 | Mohrin | |
| 5,396,747 | A | 3/1995 | Breuning | |
| 5,396,764 | A | 3/1995 | Rao et al. | |
| 6,164,063 | A | 12/2000 | Mendler | |
| 6,357,227 | B1 | 3/2002 | Neufert | |
| 6,508,210 | B2 * | 1/2003 | Knowlton et al. | 123/3 |
| 6,581,375 | B2 * | 6/2003 | Jagtoyen et al. | 60/309 |
| 6,712,869 | B2 * | 3/2004 | Cheng et al. | 55/418 |
| 6,804,949 | B2 | 10/2004 | Andrews et al. | |
| 7,302,795 | B2 * | 12/2007 | Vetrovec | 60/309 |
| 7,500,356 | B2 * | 3/2009 | Hirata et al. | 60/286 |
| 8,001,770 | B2 * | 8/2011 | Wirth et al. | 60/286 |
| 2003/0234012 | A1 | 12/2003 | Bosteels | |
| 2004/0000138 | A1 | 1/2004 | Tamura | |

FOREIGN PATENT DOCUMENTS

| | | |
|---|---|---|
| JP | 57-88213 | 6/1982 |

* cited by examiner

*Primary Examiner* — Thomas Denion
*Assistant Examiner* — Diem Tran
(74) *Attorney, Agent, or Firm* — Julia Voutyras; Alleman Hall McCoy Russell & Tuttle LLP

(57) ABSTRACT

A system for trapping liquid exhaust during a cold start of an internal combustion engine is provided. As one example, a system includes, an exhaust inlet, an exchange area fluidly coupled downstream of said exhaust inlet, a trap coupled to said exchange area having a liquid exhaust chamber for collection of liquid exhaust, and a catalytic converter fluidly coupled downstream to said exchange area. In another example, a method includes condensing, at least partly, exhaust from the engine in an exchange area in an exhaust system into liquid exhaust, collecting liquid exhaust into a trap disposed in the exchange area, and evaporating the liquid exhaust into the exchange area after an evaporation temperature is reached in the trap.

21 Claims, 4 Drawing Sheets

TRAP FOR EXHAUST SYSTEM

BACKGROUND AND SUMMARY

Emissions produced by an engine shortly after start-up may be higher than after an engine is at optimal operation temperature. Higher emissions may be due to reduced fuel vaporization and atomization under certain conditions. For example, after start-up of the engine, the fuel system pressure may not yet have attained a pressure to cause sufficient atomization of the fuel within the combustion chamber, which may result in increased emissions. Furthermore, lower engine temperatures after start-up can further reduce the vaporization rate of the fuel. As yet another example, vaporization rate can vary with fuel composition. For example, blended fuels containing gasoline and alcohol may have lower vaporization rates than fuels containing only gasoline or lower concentrations of alcohol.

For example, during a cold start, where an engine is started at a temperature below its operation threshold value, fuel may not be combusted as efficiently as when the engine operates at or above an optimal operation temperature. Cold engine temperatures may also lower the exhaust temperature, allowing for the condensation of more liquids, an example of which is water, out of exhaust gases. Thus, during cold start, emissions, such as hydrocarbons in the exhaust, including uncombusted fuel and partially combusted fuel, may be released.

Depending on the fuel, the emissions may be further increased during cold start. For example, fuels containing ethanol may have relatively low volatility. Low volatility fuels may require higher fuel to air ratios for optimal combustion and may not heat up an exhaust system or an engine as quickly as other fuels, for example gasoline. In this way, low volatility fuels may produce relatively more undesired byproducts under cold start conditions than other fuels.

A catalytic converter may be used as part of an exhaust system to convert undesired byproducts into less harmful byproducts. When the catalytic converter is at or above an optimal operation threshold value, referred to as the light-off temperature, the catalytic converter may effectively reduce such undesired byproducts. However, under cold start conditions, a catalytic converter is generally below its light-off temperature and inefficient conversion of exhaust occurs.

Systems have been developed to address the conditions which occur at cold start. For example, U.S. Pat. No. 5,396,764 describes an approach for selectively filtering exhaust gasses with a breathing bellows apparatus coupled to a solid filter which may be used for storing and oxidizing exhaust. The bellows may respond to pressure changes brought about by increased temperatures in the catalytic converter when it reaches light-off temperature, opening up an interlocking vent system that allows exhaust to by-pass the filter. Another approach described in U.S. Pat. No. 6,357,227 uses a bypass in the exhaust system, so that undesired byproducts are oxidized by an aqueous reagent. The bypass system may be controlled by valves and in some examples includes multiple compartments for storing water and reactants, such as urea, to produce reagents, such as ammonia.

The inventors herein have recognized various issues related to these approaches. For example the use of breathing bellows and solid filtering systems may be subject to high amounts of wear and tear and may depend on complicated mechanical systems for selectively filtering the exhaust. Further, the use of chemical reagents may require continual addition of said chemicals to an exhaust system. Additionally, reagents, such as ammonia, may be undesirable themselves and may cause harm to the environment. Furthermore, such approaches do not specifically address the concerns related to emissions from less volatile fuels, for example ethanol.

As one approach, the inventors have recognized that at least some of the above issues may be addressed by a system adapted to trap liquid exhaust in an engine's exhaust system during cold start before a catalytic converter reaches its light-off temperature. In one example, a portion of the exhaust may be condensed to form liquid exhaust. The liquid exhaust may be stored in a trap and release delayed until after light off temperature is reached. As such, the level of wet exhaust reaching the catalytic converter prior to light off temperature being obtained may be reduced. Reducing the emissions during cold start, results in an increase in the efficiency of the exhaust system. Such systems, devices and methods may be applied to an ethanol-based fuel system.

DETAILED DESCRIPTION

Figure 1:
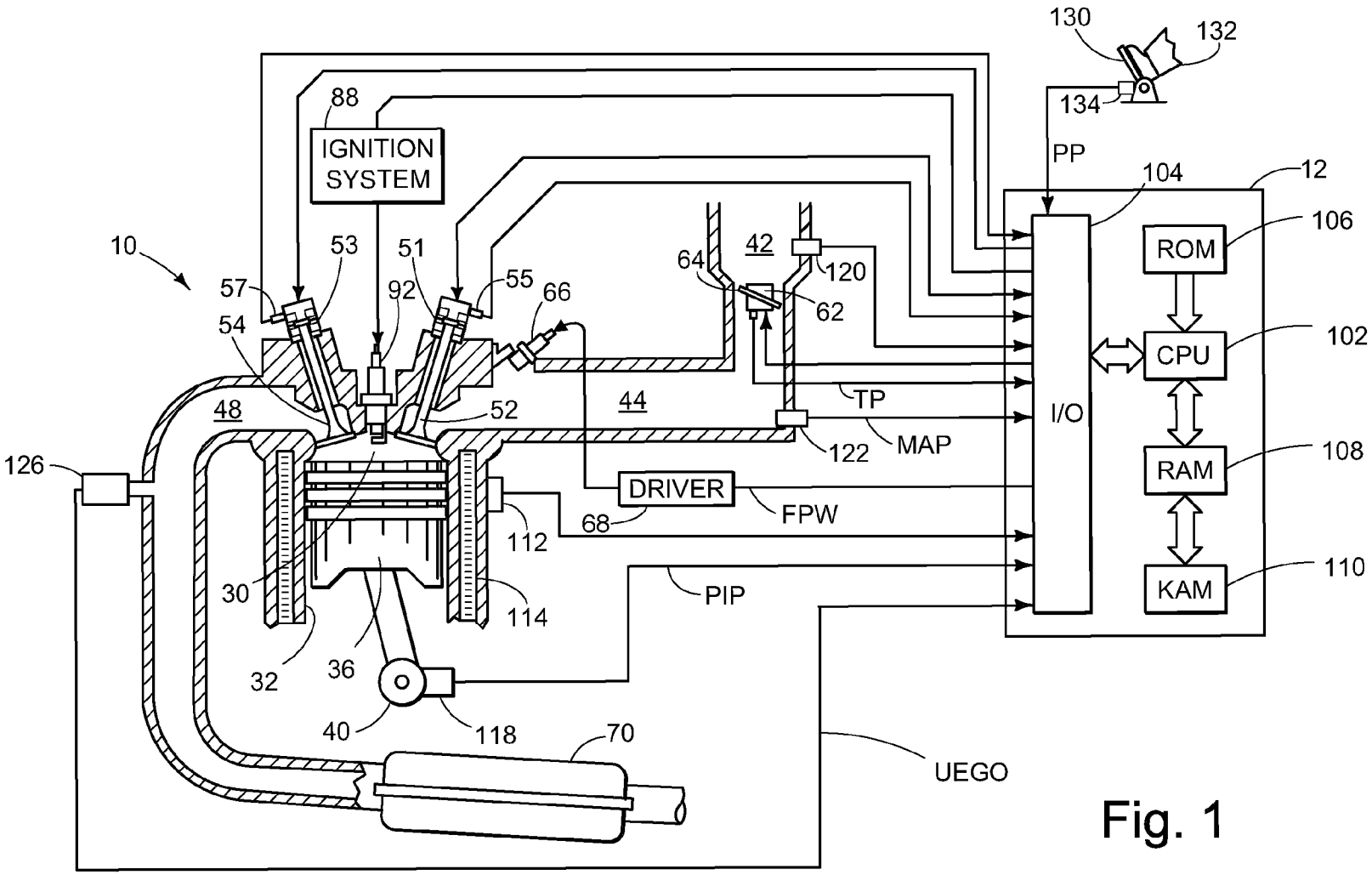
FIG. 1 shows a schematic depiction of an example cylinder of an internal combustion engine including an exhaust system.

FIG. 1 is a schematic diagram showing one cylinder of multi-cylinder engine 10, which may be included in a propulsion system of an automobile. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e. cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10. Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

Intake valve 52 may be controlled by controller 12 via electric valve actuator (EVA) 51. Similarly, exhaust valve 54 may be controlled by controller 12 via EVA 53. During some conditions, controller 12 may vary the signals provided to actuators 51 and 53 to control the opening and closing of the respective intake and exhaust valves. The position of intake valve 52 and exhaust valve 54 may be determined by valve position sensors 55 and 57, respectively. In alternative embodiments, one or more of the intake and exhaust valves may be actuated by one or more cams, and may utilize one or more of cam profile switching (CPS), variable cam timing (VCT), variable valve timing (VVT) and/or variable valve lift (VVL) systems to vary valve operation. For example, cylinder 30 may alternatively include an intake valve controlled via electric valve actuation and an exhaust valve controlled via cam actuation including CPS and/or VCT.

Fuel injector 66 is shown arranged in intake passage 44 in a configuration that provides what is known as port injection of fuel into the intake port upstream of combustion chamber 30. Fuel injector 66 may inject fuel in proportion to the pulse width of signal FPW received from controller 12 via electronic driver 68. Fuel may be delivered to fuel injector 66 by a fuel system (not shown) including a fuel tank, a fuel pump, and a fuel rail. In some embodiments, combustion chamber 30 may alternatively or additionally include a fuel injector coupled directly to combustion chamber 30 for injecting fuel directly therein, in a manner known as direct injection.

Intake passage 42 may include a throttle 62 having a throttle plate 64. In this particular example, the position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 48 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 48 downstream of exhaust gas sensor 126. Device 70 may be a three way catalyst (TWC), NOx trap, various other emission control devices, or combinations thereof. In some embodiments, during operation of engine 10, emission control device 70 may be periodically reset by operating at least one cylinder of the engine within a particular air/fuel ratio.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

Storage medium read-only memory 106 can be programmed with computer readable data representing instructions executable by processor 102 for performing the methods described below as well as other variants that are anticipated but not specifically listed.

As described above, FIG. 1 shows only one cylinder of a multi-cylinder engine, and that each cylinder may similarly include its own set of intake/exhaust valves, fuel injector, spark plug, etc.

Figure 2:
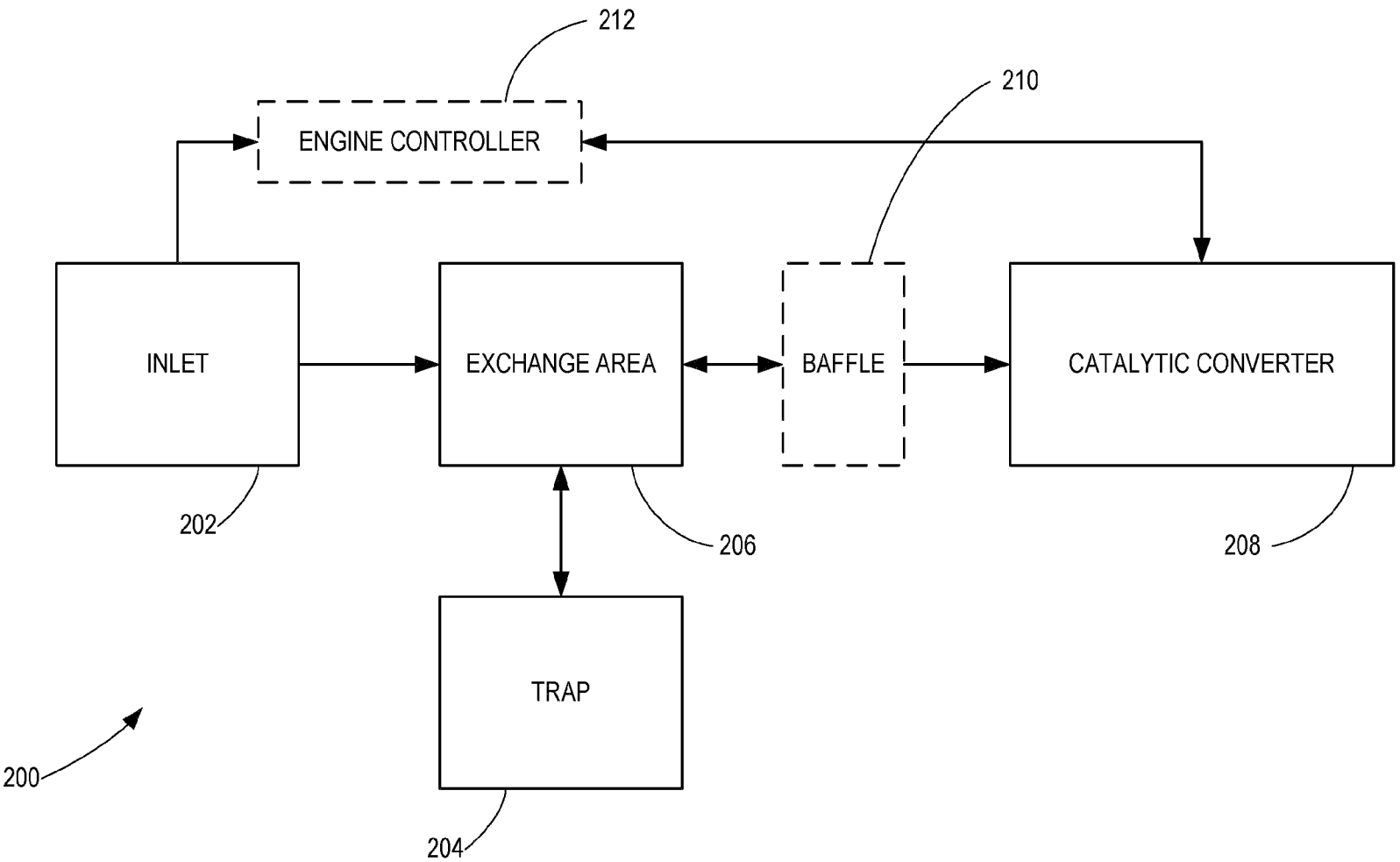
FIG. 2 is a block diagram of an exhaust system including a trap for collection of liquid exhaust.

FIG. 2 depicts a system 200 for trapping liquid exhaust in an exhaust system to reduce emissions during cold start. Liquid exhaust, for example, may include water, fuel and condensates of exhaust gases or other exhaust particulates. For example, the liquid exhaust may include hydrocarbons, including uncombusted fuel and partially combusted fuel, as well as other particulate matter, etc. The system may be disposed as part of emissions control device 70 described in regards to FIG. 1.

System 200 may include an inlet 202, such as an exhaust inlet, which may be coupled to an exchange area 206 which in turn may be coupled to a trap 204. Inlet 202 may be adapted to enable passage of exhaust from the engine to the exchange area. The exhaust may include liquid exhaust as well as exhaust gases and particulates.

Exchange area 206 may be coupled to a catalytic converter 208. Exchange area 206 may include a passage to the catalytic converter. A trap 204, such as liquid trap or cold start trap, may be disposed to collect liquid exhaust during cold start. In one example, the trap may be disposed in the bottom recess of the exchange area to enable gravity dripping of liquids into the trap. Vapors and exhaust which are not collected in the trap may pass through to catalytic converter 208.

As one example, the trap may be adapted for the storage and evaporation of liquids, such as liquid exhaust. The trap may include a mouth or opening into the exchange area, a passageway coupled to the mouth and a liquid exhaust chamber for collecting the liquid exhaust. In one example, the opening of the trap is disposed such that liquid exhaust may drop into the trap. As another example of a trap configuration, the trap may be adapted as a Helmholtz resonator as described in regards to FIG. 3.

In some examples, the trap may further include a heat shield, insulation and/or subsidiary connections to other portions of the exhaust system. The heat shield and insulation may at least partially surround or insulate the trap and may limit the transfer of heat away from and to the chamber. Subsidiary connections may enable fluid to flow into or out of the trap. In this way flow may be directed back toward the exchange area, another part of system 200, or somewhere else. Further, connections may be provided to enable evaporation of the liquid exhaust such that it reenters the system. For example, after trapping the liquid during the cold start, the liquid exhaust may be evaporated back into the exchange area after the engine has reached an optimal operation temperature. The evaporated exhaust may be efficiently processed by the catalytic converter after it has reached its light off condition. In other systems, the liquid exhaust may be evaporated into a second outlet or otherwise released.

As described above, the trap may be coupled to the exchange area, which may in turn be coupled to the catalytic converter 208. It should be appreciated that the exchange area may be the entrance to the catalytic converter. For example, catalytic converter 208 may be disposed downstream of exchange area 206 and downstream of baffle 210 (described below). The catalytic converter may include a Three Way Catalyst (TWC) for reducing $NO_x$ gases and oxidizing hydrocarbons and carbon monoxide. In another example, the catalytic converter may contain a $NO_x$ trap. In yet a further example the catalytic converter may include a combination of TWC, $NO_x$ trap, and other emissions reducing devices. In still another example, the catalytic converter may include a heater, such as, but not limited to an electric coil, a recirculated exhaust exchange, etc., which may be thermally coupled to one or more emissions reducing devices. As described above, during a cold start, the catalytic converter is not at efficient operating temperatures. By using the liquid exhaust trap, it may be possible to retain exhaust while the catalytic converter is heated to its light off temperature. In this way, the amount of undesired byproducts emitted by the exhaust system may be reduced. Further, in some examples, it is possible to delay the release of the dry exhaust from the liquid exhaust trap to a position downstream of the first brick of the catalytic converter.

In some example systems, an optional baffle 210 disposed between the exhaust inlet and the catalytic converter. For example, the baffle may be disposed upstream of the catalytic converter and downstream of the exchange area. As described in more detail below, the baffle may redirect a portion of the air flow back upstream to the exchange area to increase collection of liquid exhaust during cold start. For example, the baffle may be a grouping of bendable flaps, a blockage with perforations, a web of interconnected fibers, a system of circular pin-wheel like arms or other such device. In one example, the baffle may partly slow the flow of exhaust and redirect exhaust back toward the exchange area. Slowing and redirecting airflow may improve the level of condensation in the exchange area and increase the level of liquid exhaust which is collected in the trap. Increasing the collection of liquid exhaust may reduce the amount of exhaust which is passed to the catalytic converter, therefore increasing the overall efficiency of the system prior to the catalytic converter reaching light off temperature. In another example, the baffle may increase centrifugal action of the airflow to stratify condensate near the opening of the trap 204. In this way, air may circulate in the exchange area to enable condensation and trapping of exhaust gases.

In addition to the above elements, in some systems, an engine controller 212, with one or more engine sensors, may be provided to enable control of the system. For example, one or more exhaust sensors may be coupled to the exhaust system 200, such as to inlet 202, and to engine controller 212. The exhaust sensor may be an example of exhaust gas sensor 126. In this way, information about the exhaust may be signaled to the controller. In another example, the engine controller may be coupled to the catalytic converter. In a further example, the engine controller may be coupled to a heater on the catalytic converter that it may control. In this way, the engine controller may control the heating of some portion of the catalytic converter.

Figure 3:
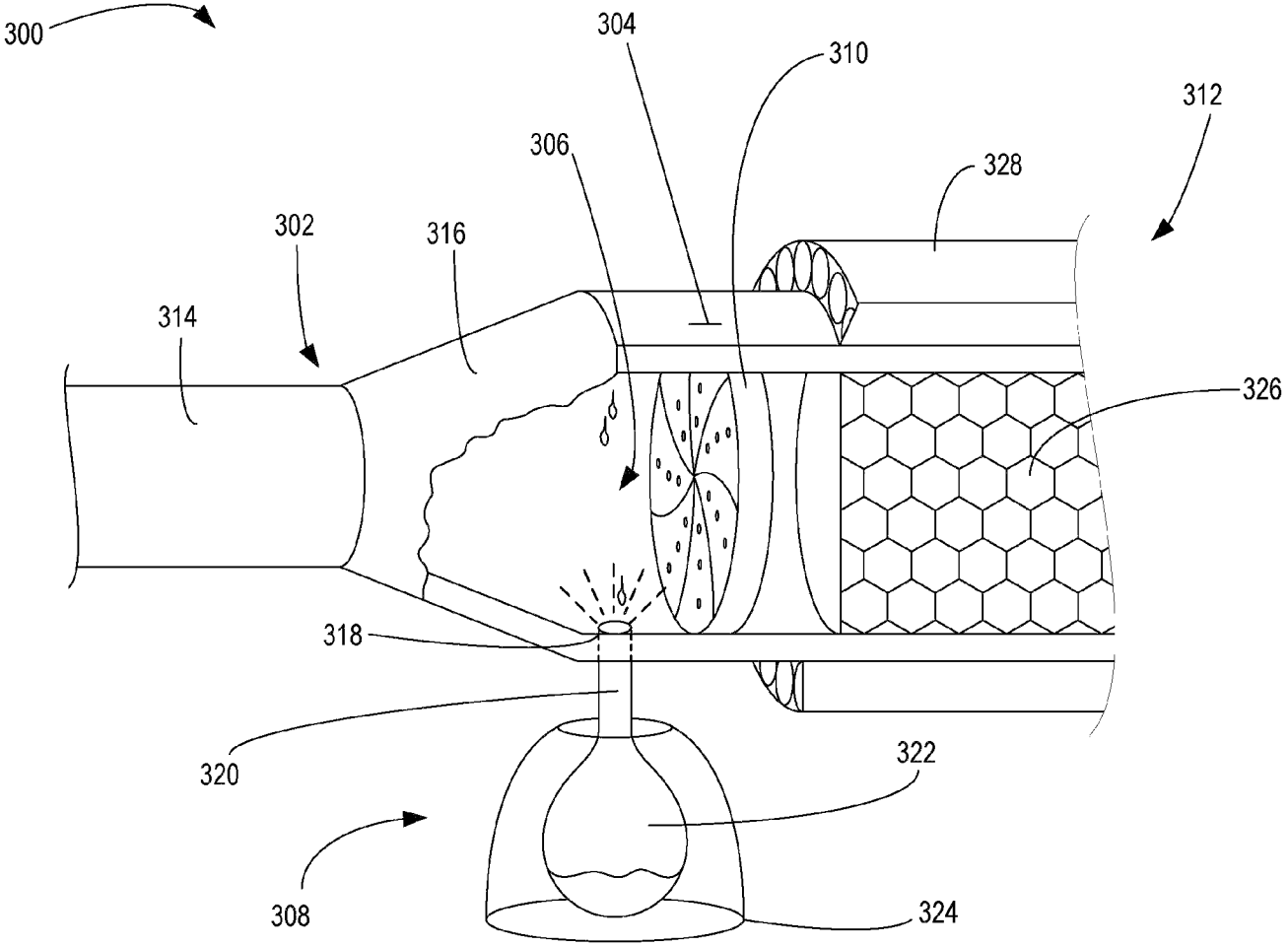
FIG. 3 is a schematic illustration of an example exhaust system including a trap for collection of liquid exhaust.

FIG. 3 is an example of an exhaust system with a liquid trap. System 300 includes an inlet 302, an emissions reduction device housing 304 an exchange area 306, a trap 308, a baffle 310, and catalytic converter 312. As described below in more detail, in one example, the system includes an exhaust inlet, an exchange area fluidly coupled downstream of said exhaust inlet, a trap coupled to said exchange area having a liquid exhaust chamber for collection of liquid exhaust, and a catalytic converter fluidly coupled downstream to said exchange area. In some examples, the trap may include a drain opening into an exchange area of an exhaust system, and a chamber fluidly coupled to the drain, where the chamber is adapted to passively receive liquid exhaust from the exchange area. For example, the drain may receive gravity dripped liquid exhaust from the exchange area. In some examples, a portion of the exchange area is at least partially sloped to enable flow of the liquid exhaust into the trap. The trap may further include a passageway fluidly linking the drain and the chamber. The passageway may be adapted to enable evaporation of the liquid exhaust and release of the evaporated liquid exhaust into the exchange area.

As an example, inlet 302 may include an exhaust manifold 314 coupled to a reducer cone 316 that may be coupled to emissions reduction device housing 304. The manifold may direct exhaust from the engine to the reducer cone, although such a reducer cone is not required. In some examples, the inlet may be directly connected from the engine's exhaust valve. Although not illustrated, one or more exhaust sensors may be coupled to the exhaust gas manifold.

Exhaust in one example may be produced from an engine burning ethanol-based fuel, such as E85. E85 is a fuel that contains a mixture of up to 85% denatured fuel ethanol. Ethanol fuel may have a higher octane rating than other fuels, such as gasoline. A higher octane rated fuel may be more efficient than fuels with lower octane ratings. E85 may be produced from grasses, such as corn. In this way, E85 may not produce a net increase in carbon into the atmosphere. However, E85 may have a lower volatility than other fuels, such as gasoline. Lower volatility fuels may require higher fuel to air ratios for optimal combustion in an engine and may not heat up an exhaust system or an engine as quickly as other fuels, for example gasoline. In this way, low volatility fuels may produce relatively more undesired emissions under cold start conditions than other fuels.

As an example and not as a limitation, the system may reduce emissions when using E85. For example, as described in more detail below, the liquid trap may include a liquid exhaust chamber disposed below the entrance to the catalytic converter to catch dripping liquid exhaust during a cold start. After the catalytic converter is warmed up, the captured liquid exhaust may evaporate and be released to the catalytic converter. By providing the trap, the liquid exhaust is retained until the catalytic converter is sufficiently heated, thus minimizing the difficulties which occur with low volatility fuels during cold start.

Referring now specifically to FIG. 3, an exchange area 306 may transfer exhaust, such as liquid exhaust and exhaust gas. The exchange area may be a transfer connection inside the emissions reduction device housing 304 coupled to reducer cone 316, trap 308 and optionally baffle 310. The exchange area may include a drain 318 that enables liquid to be gravity dripped into trap 308. Further, in some examples, pressure pulsations may further drive the liquid exhaust into the trap.

In the illustrated example, the exchange area may direct the flow of liquids toward the drain. For example, structure in the exchange area, such as the bottom pan or floor of the exchange area, may be sloped or at least partially sloped, to enable the liquid exhaust to flow into trap 308. For example, the exchange area may include another reducer cone to direct flow toward the drain.

Moreover, in some examples, additional structure may be disposed in the exchange area to force air circulation to enable condensation and to further direct the flow of liquids toward the trap. For example, one or more of the following structures may be integrated within the system. Specifically, as one example, a heat exchanger may be added to reduce the thermal energy in the exhaust gases and increase condensation. In other examples, a heat exchanger may be coupled upstream or downstream of the exchange area. In still further examples, a tortuous path device may be added to the exhaust system. For example, a tortuous path may be disposed between the inlet and the exchange area. In some systems, the tortuous path may be upstream or downstream of the exchange area. In other examples, the length of exhaust system may be extended. By adding such structure, for example, a tortuous path or extending the length of the exhaust system, the path that exhaust gases take before reaching the catalyst are increased and thus adding exhaust gas thermal mass. In this way condensation and trapping of exhaust liquid may be increased.

Referring back to trap 308, the trap may be configured to temporarily store and evaporate liquid exhaust. The trap includes a mouth or drain 318, and passageway 320, and a liquid exhaust chamber 322. In some examples, the liquid exhaust chamber may be connected directly to the drain without a passageway. In other examples, the trap chamber may be connected to the drain by a flange. Although not required, a heat shield 324 may be disposed around or partially around liquid exhaust chamber 322.

Drain 318 may be adapted to enable the flow of liquid exhaust between the passageway (and thus the liquid exhaust chamber) and the exchange area. Flow of liquid exhaust into the liquid exhaust chamber may occur through the drain and the passageway. After heating, evaporated liquid exhaust may travel through the passageway and back into the exchange area.

The liquid exhaust chamber may be shaped to enable collection of liquid exhaust. Further, the shape may be such that upon heating, the liquid exhaust rapidly evaporates and may be released up through the passageway back into the exchange area. For example, the liquid exhaust chamber may be bulbous or spherical, forming a bowl to collect the liquid exhaust. The bowl shape may enable a sufficient amount of liquid to collect in the chamber while still maximizing the surface area to ensure rapid evaporation upon heating. Although illustrated as a bulbous chamber, it should be appreciated that other configurations are possible, including, but not limited to a multiple-bulbed chamber, or a tube-like chamber.

In one example, the trap functions as a Helmholtz resonator. In the example Helmholtz resonator trap, combustion in the engine may cause pressure changes in the emissions reduction device housing which may, in turn, induce a breathing effect in the trap. Breathing may break surface tension and wetting that inhibits gravity drip as well as aerate condensate into the chamber, wet crevices and improve the trap's efficiency. Further, in some examples the chamber may be configured to allow enough time for the catalytic converter to heat up and then vaporize the condensate as it evaporates. For example, a hole may be provided to enable a plume of exhaust gases to be directed into the flow stream of the catalytic converter after the catalytic converter has reached light off temperature. In alternate examples, the trap is not designed as a Helmholtz resonator and may utilize other structures to enable liquid exhaust trapping.

As an example, the position of the drain may be varied to increase collection of liquid exhaust. As described above, the drain may be disposed on the lowest point of the exchange area. Further, the drain size may be increased to enable more collection of liquid exhaust. Similarly the volume size of the liquid exhaust chamber may be varied to enable sufficient collection room and to enable evaporation (or boiling off) of the liquid exhaust.

During cold start, liquid exhaust may be collected and stored in the trap. As the engine and exhaust system is heated, the system may more efficiently process emissions. Thus, in some systems, the trap may be adapted to enable release of the liquid exhaust back into the system once the catalytic converter reaches its light off condition. For example, as described in more detail below, the trap may be adapted to enable the liquid exhaust to evaporate back into the exchange area.

For example, in the illustrated system, liquid exhaust may be stored in chamber 322 until the chamber is heated to a temperature that causes the evaporation of said liquid. The heating may be caused by convection from exhaust gases, radiation from another part of the exhaust system or engine system, or thermal conduction from another part of the system. In some examples, the trap may feature a heater, such as a heating coil (not shown), which may heat the chamber. The chamber may be thermally insulated by a heat shield 324. The heat shield may limit radiation from another part of the exhaust system or engine system, or thermal conduction from another part of the system. In order to prevent premature release of the liquid exhaust (prior to the catalytic converter reaching light off condition), thermal insulation may allow delay of evaporation of the liquid exhaust out of the trap. Once the catalytic converter has reached light off condition, various heating elements and heaters may be utilized to enable the liquid exhaust to evaporate back into the exchange area.

When liquid exhaust evaporates, it may rise, leaving the chamber 322 through the passageway 320 to exchange area 306. In alternate examples, subsidiary channels may enable the transport of liquid exhausts, and/or evaporated liquid exhausts, between the trap and the exchange area. In other examples, subsidiary channels may enable the transport of liquid exhausts and/or evaporated liquid exhausts, between the trap and reducer cone 316. In further examples, subsidiary channels may enable the transport of liquid exhausts and/or evaporated liquid exhausts, between the trap and other parts of the engine system or the exhaust system.

Various optional structures may be disposed within the reducer cone 316 to increase the collection of liquid exhaust during cold start. As described above, downstream of the exchange area 306, one or more baffles 310 may be disposed. Although illustrated as a circular pin-wheel like structure with slitted arms and perforations, the baffle may be of any suitable shape to disrupt exhaust flow. The baffle may be used to increase the centrifugal action of the flow. Increasing the centrifugal action of the flow may stratify condensate near the trap, improving the trap's efficiency. The baffle may be used to partly slow and redirect air flow back toward the exchange chamber. Slowing and redirecting airflow may improve the level of condensation in the exchange area. In alternate examples, the baffle may be a grouping of bendable flaps, a blockage with perforations, a web of interconnected fibers, or other such structure.

In the illustrated example of FIG. 3, downstream of baffle 310 is a catalytic converter. In one example, the catalytic converter includes a three way catalyst 326 (TWC). The catalytic converter may be heated by engine exhaust, and may also include a heater 328, thermally coupled to the TWC. In the present example, the heater is an electric coil in thermal conduction with the emissions reductions device housing 304 and the TWC. In another example, the heater may include an exhaust by-pass device to direct recirculated exhaust around the TWC. In an alternate example, the heater is absent. In another alternate example, the catalytic converter further includes a $NO_x$ trap downstream of the TWC. In such an example, retaining water and exhaust gases until the catalytic converter reaches light off temperature may increase the efficiency of the $NO_x$ trap. In still other examples the $NO_x$ trap is in thermal communication with the heater 328.

As described in regards to FIG. 2, an engine controller and engine sensors may be coupled to the system. For example, an engine controller may be coupled to heater 328 and an exhaust sensor, to actively monitor and control heating of the catalytic converter. In other examples, the controller may be coupled to a heater linked to trap 308 to monitor and control heating of the trap.

Figure 4:
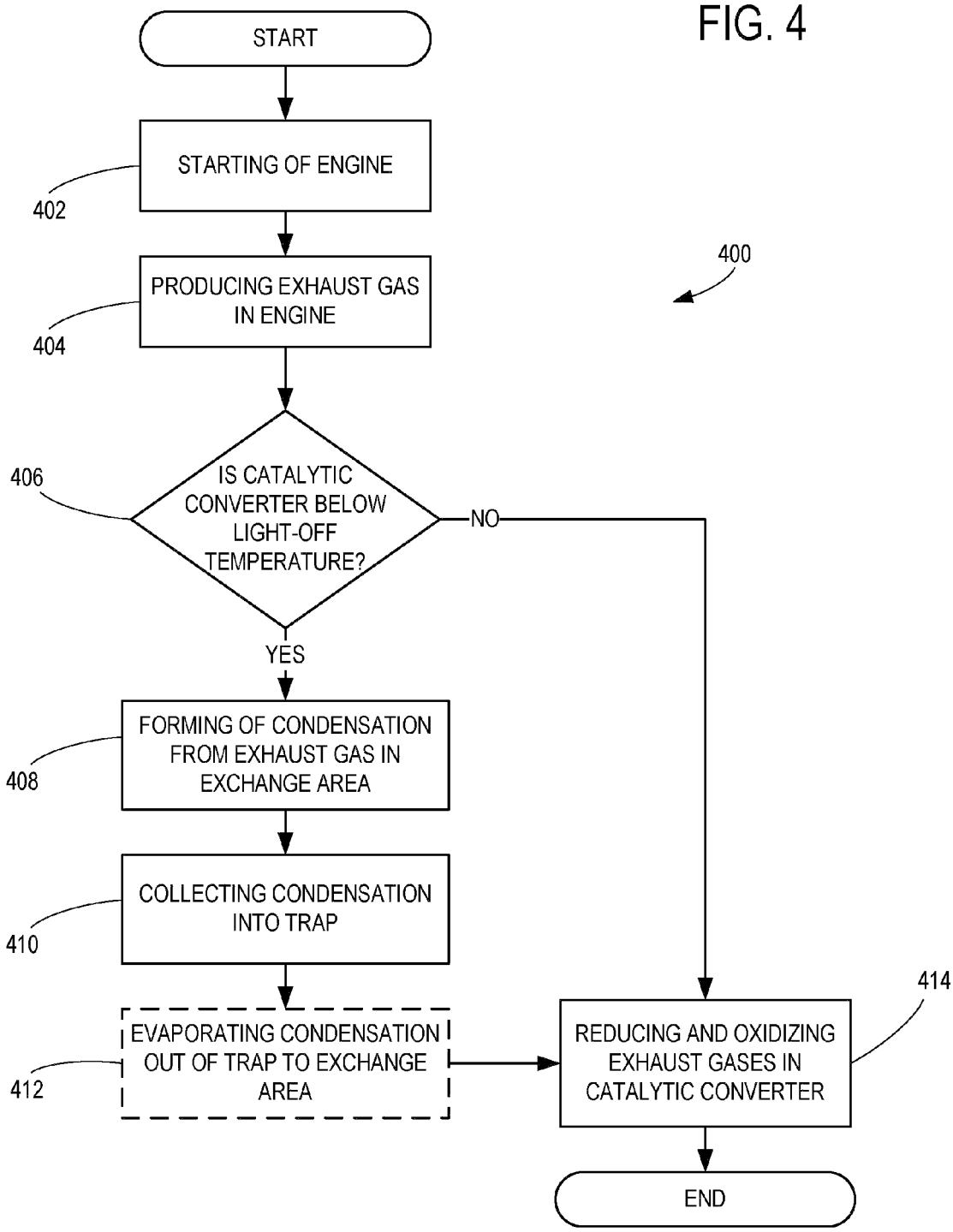
FIG. 4 is a flow chart of an example method by which an exhaust system may retain liquid exhausts during cold start.

FIG. 4 is flow chart depicting an example approach 400 for reducing emissions during cold start in a directly injected internal combustion engine as shown in FIG. 1. In particular, the approach may improve the overall efficiency of an exhaust system. Although not all elements are required, for purposes of the illustration, the example exhaust system for the described approach includes: an inlet, a trap, an exchange area, and a catalytic converter.

The method may begin with starting an engine, as indicated at 402. After starting, the engine may produce exhaust gas, at 404. At 406, a determination of the operating conditions of the catalytic converter (e.g. whether the catalytic converter is below light-off temperature) may follow. This determination may be done passively by the creation of water and condensed exhausted gases in the exhaust system which may be due to cold start conditions. Alternately, and/or additionally, an exhaust gas sensor may signal the status of the catalytic converter to an engine controller. For example, a temperature sensor may be coupled to the catalytic converter and signal the engine controller.

If the catalytic converter is above light-off temperature, then emissions, such as exhaust gas, may be oxidized and reduced in catalytic converter, at 414.

Although described in regards to a determination of the operating conditions of the catalytic converter, the determination of where there is a cold start condition or the operation condition of the engine. Thus, if there is no cold start condition or if the engine is above or at optimal operating condition, then the routine may pass to 414 and the exhaust gas processed by the catalytic converter.

If the catalytic converter is below light-off temperature (or if the engine is in a cold start condition), then the routine passes to 408. In the example, liquid exhaust may collect in the exchange area and undesired byproducts in exhaust gases, for example hydrocarbons and water, may form condensate. As described above, the formation of condensate, liquid exhaust, may be a passive process, implicit in the cold starting condition of the engine.

In some examples, the method may further include a baffling process to disturb the airflow and increase the condensate. For example, the baffling may increase the centrifugal action of the exhaust flow through the system. Increasing the centrifugal action of the flow may stratify condensate near the trap, improving the trap's efficiency. In other examples, baffling may be used to partly slow and redirect air flow back toward the exchange chamber. Slowing and redirecting airflow may increase the level of condensation in the exchange area.

In further examples, additional methods may be used alone or in combination with the baffling to increase condensation. For example, a heat exchanger may be integrated within the system. Further example processes may include extending the period of time the exhaust gases flow through the exhaust system and increasing exhaust gas thermal mass due to physical length of the exhaust system. In some embodiments, a tortuous path device may be added to the exhaust system. In a further example, the length of exhaust system may be extended, for example the exchange area itself may be extended. In this way the path that exhaust gases take before reaching the catalyst is increased, enabling condensation and trapping of exhaust liquid.

Liquid condensation, or liquid exhaust, which may contain undesired byproducts, for example hydrocarbons and water, may be collected in the trap, at 410. The above steps 404 through 410 may be carried out repeatedly. The liquid exhaust may be retained within the trap during the period where the system reaches optimal operating conditions, e.g. the catalytic converter reaches light-off temperature.

At 412, the liquid exhaust may be evaporated from the trap into the exchange area. The evaporation may be controlled based on the temperature of the trap, the temperature of the catalytic converter, and/or the temperature of the engine. The evaporation may be carried out passively by heating from exhaust gases. In some examples, the trap may further comprise a heating element that may actively undertake heating the liquid in the trap to accelerate evaporation upon a desired condition of the engine or catalytic converter. In one example, the evaporation is substantially delayed until the catalytic converter has reached light-off temperature.

It should be appreciated that in some examples, instead of the evaporation step at 412, the trap may be adapted to retain or redirect the liquid exhaust. For example, liquid exhaust may be directed to another part of the system for use in another process.

Referring back to FIG. 4, after evaporation of the liquid exhaust back into the exchange area, the evaporated liquid exhaust may be reduced and oxidized in the catalytic converter at 414.

Thus, as described in detail above, a method of operating an internal combustion engine during cold start is provided. The method may include, condensing, at least partly, exhaust from the engine in an exchange area in an exhaust system into liquid exhaust, collecting liquid exhaust into a trap disposed in the exchange area, and evaporating the liquid exhaust into the exchange area after an evaporation temperature is reached in the trap. The evaporating of the liquid exhaust may be delayed until after the catalytic converter is at a light off condition. In some examples, the centrifugal action of the exhaust in the exchange area may be increased by using baffles or other air disturbance structures. The evaporated liquid exhaust may be reduced and oxidized in a catalytic converter after the system gets to light off temperatures.

Note that the example routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, V-8, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system for trapping liquid exhaust during an internal combustion engine cold start, comprising:

an exhaust manifold coupled to a reducer cone;

an exchange area coupled downstream of said exhaust manifold at a juncture of the reducer cone and an emissions reduction device housing;

a trap comprising a drain opening into the exchange area and a liquid exhaust chamber fluidly coupled to the drain, the chamber receiving gravity dripped liquid exhaust from the exchange area and the exchange area receiving evaporated liquid exhaust from the chamber; and a catalytic converter fluidly coupled downstream of said exchange area in the housing.

2. The system of claim 1, further comprising a baffle disposed between the drain and the catalytic converter.

3. The system of claim 1, further comprising a heater coupled to the trap.

4. The system of claim 1, wherein the trap further includes a heat shield.

5. The system of claim 1, wherein a portion of the exchange area is at least partially sloped to enable flow of the liquid exhaust into the trap.

6. The system of claim 1, wherein the trap is a Helmholtz resonator.

7. The system of claim 1, further comprising an engine controller coupled to at least one of said engine, said catalytic converter, and an exhaust inlet, where the exhaust inlet includes said exhaust manifold coupled to said reducer cone.

8. The system of claim 1, wherein the catalytic converter includes a $NO_x$ trap.

9. A device comprising:

a drain opening into an exchange area, the exchange area fluidly coupled downstream of an exhaust manifold at a juncture of a reducer cone and an emissions reduction device housing and upstream of a baffle with a circular pin-wheel structure; and a chamber fluidly coupled to the drain, the chamber receiving gravity dripped liquid exhaust from the exchange area and the exchange area receiving evaporated liquid exhaust from the chamber.

10. The device of claim 9, further comprising a passageway fluidly linking the drain and the chamber.

11. The device of claim 9, further comprising a heat shield at least partially insulating the chamber.

12. The device of claim 9, wherein the chamber is a Helmhotz resonator.

13. The device of claim 9, wherein the chamber is bulbous.

14. The device of claim 9, wherein the baffle is disposed downstream of the drain and inside of the housing upstream of a catalytic converter.

15. A method of operating an internal combustion engine during cold start, comprising:

condensing, at least partly, exhaust from the engine in an exchange area in an exhaust system into liquid exhaust;

collecting liquid exhaust into a trap, the trap comprising an opening into the exchange area and a passageway coupling the opening to a liquid exhaust chamber; and evaporating the liquid exhaust from the chamber into the exchange area via the passageway after an evaporation temperature is reached in the trap.

16. The method of claim 15, wherein evaporating the liquid exhaust is delayed until after a catalytic converter is at a light off condition.

17. The method of claim 15, further comprising increasing the centrifugal action of the exhaust in the exchange area via a baffle disposed upstream of a catalytic converter and downstream of the opening of the trap.

18. The method of claim 15, wherein the exhaust is E85 exhaust.

19. The method of claim 15, further comprising reducing and oxidizing the evaporated liquid exhaust in a catalytic converter.

20. The method of claim 19, wherein the catalytic converter includes a $NO_x$ trap.

21. The method of claim 17, further comprising redirecting a portion of exhaust flow back upstream to the exchange area via the baffle.

* * * * *